US006244300B1

(12) United States Patent
Pacana

(10) Patent No.: US 6,244,300 B1
(45) Date of Patent: Jun. 12, 2001

(54) VANE RAIL AND ITS ASSEMBLY FOR AN AIR DUCT

(75) Inventor: David M. Pacana, Spring City, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/458,635

(22) Filed: Dec. 10, 1999

(51) Int. Cl.[7] ..... F15D 1/04
(52) U.S. Cl. ..... 138/39; 138/37
(58) Field of Search ..... 138/39, 37; 137/561 A; 29/513

(56) References Cited

U.S. PATENT DOCUMENTS 3,405,737 * 10/1968 Harper ..... 138/39
3,602,262 * 8/1971 Hinden ..... 138/39
4,467,829 8/1984 Myers ..... 138/374
4,586,540 * 5/1986 DeLord ..... 138/37 X
4,641,684 * 2/1987 DeLord ..... 138/37 X
4,911,205 * 3/1990 Myers ..... 138/39
5,529,092 6/1996 Arnoldt ..... 138/39
5,927,339 * 7/1999 Ellis et al. ..... 138/39

* cited by examiner

*Primary Examiner*—Patrick Brinson
(74) *Attorney, Agent, or Firm*—Paul & Paul

(57) ABSTRACT

A vane rail has a plurality of tabs, in pairs, partially severed therefrom, to engage air deflection vanes in sandwiched relation therebetween. Fasteners may secure the connection between the sandwiching tabs and the vanes. When vanes and a pair of rails are used together in engagement with the vanes, an assembly is provided for disposition in an air duct for intercepting air flow in a duct and diverting it to a different direction.

24 Claims, 6 Drawing Sheets

VANE RAIL AND ITS ASSEMBLY FOR AN AIR DUCT

BACKGROUND OF THE INVENTION

In air ducts for commercial and residential installations, for heating, ventilating and air conditioning systems, it is known that it is frequently desirable to provide a means for facilitating the turning of air from one direction to another within the duct. Such turning of air in a duct not only assists in the delivery of air in a most efficient manner, but also reduces the energy requirements for delivering air around comers.

Accordingly, there has developed the use of turning vanes for assisting the turning of air. Such vanes are sometime of sheet metal construction. Other times they are constructed of a fibrous material, such as fiberglass formed and reinforced with plastic resin or the like. Examples of turning vanes are present in U.S. Pat. Nos. 4,467,829 and 5,529,092.

Often, the turning vanes are mounted on rails disposed on opposite sides of a duct, inside the duct, generally at the junction where the duct is enabling a change in direction of air flow. Usually, a plurality of vanes will be mounted in the duct at that location, to allow for the impingement of air at various locations where the turn in air flow is to be effected in the duct.

It is also known in the art to make the rails that hold the vanes out of sheet metal, and to perforate the sheet metal to allow for the formation of tabs from the sheet metal, which tabs may be bent at right angles to the rail to engage the vanes and hold them in place.

Where the vanes are of a fibrous material, it is known to have tabs inserted into the fibrous material, often with barbs or other sharp edges associated with the tabs, to engage inside the fibrous material of the vanes, in order to hold the vanes onto the tabs, to prevent the vanes from moving under any forces applied by blown air coming through the ducts and engaging the vanes.

However, the application of the tabs into the vanes tends to disturb the structural integrity of the vanes and can result in reducing the ability of the rail tabs to hold the vanes in place over time.

SUMMARY OF THE INVENTION

The present invention is directed to an improvement in the manner in which rail tabs engage vanes, by avoiding interference with the structural integrity of the vanes, particularly when the vanes are of fibrous construction, but not limited thereto.

In accordance with the present invention, the vanes are held at each end by a plurality of tabs, in sandwiched relation.

Accordingly, it is a primary object of this invention to provide a novel vane rail for mounting air turning vanes, wherein each rail has a base with a plurality of pairs of tabs adapted to receive an end of an air turning vane between each pair of tabs, in sandwiched relation.

It is another object of this invention to provide an air turning vane and rail assembly wherein the vanes are engaged between pairs of tabs of a rail, in sandwiched relation.

It is a further object of this invention to provide an air duct assembly having a plurality of air duct legs and an air turning section, having the vane and rail assembly of the object immediately above.

Other objects and advantages of the present invention will be readily apparent upon a reading of the following brief description of the drawing figures, the detailed descriptions of the preferred embodiments, and the appended claims.

BRIEF DESCRIPTIONS OF THE DRAWING FIGURES

DETAILED DESCRIPTION OF PREFERRED EMBODIMENTS

Figure 1:
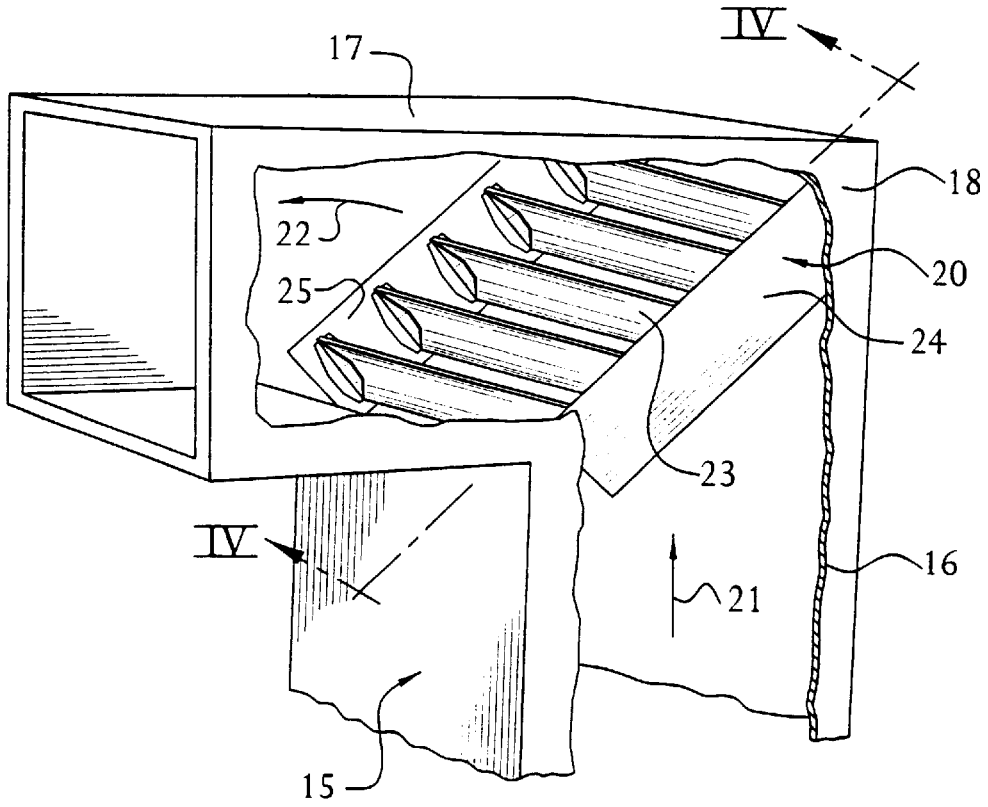
FIG. 1 is vertical perspective view of an air duct having two legs on each side of a section for turning the air, with the front wall thereof being illustrated broken away, in order to show an air turning vane and rail assembly disposed therein, embodying this invention.

Referring now to the drawings in detail, reference is first made to FIG. 1, wherein there is illustrated an air duct generally designated by the numeral 15, having a first leg 16, a second leg 17 at right angles to leg 16, and an air turning section 18 therebetween. The duct 15 will generally be of sheet metal construction, but can be of plastic construction, fiberboard construction, or any other construction as may be desired. An air turning vane and rail assembly 20 is shown mounted in duct section 18, by means of usual screws, rivets, etc. (not shown). The vane and rail assembly 20 is adapted to engage air being blown vertically upwardly in the direction of arrow 21 through leg 16, and to turn the same, essentially at right angles in the direction of arrow 22.

As air turns, it does so by engaging against a plurality of vanes 23 of the assembly 20.

Figure 2:
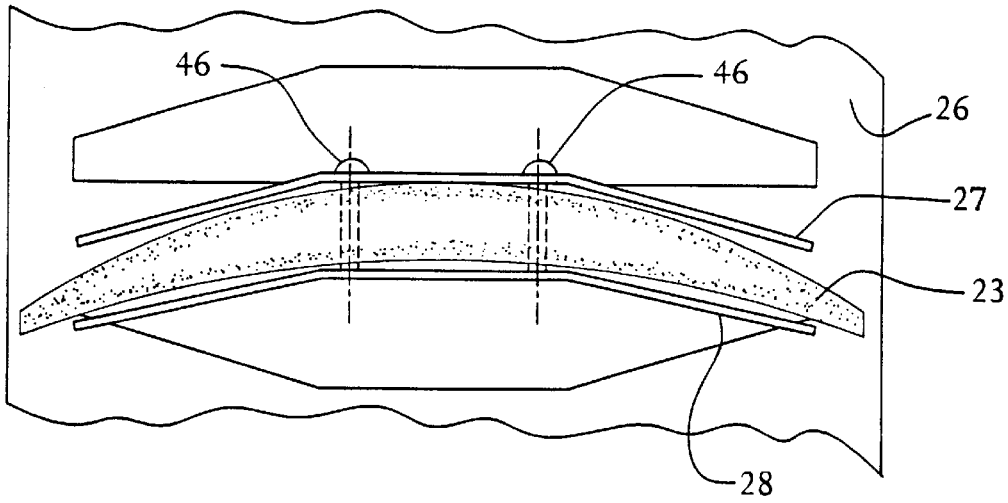
FIG. 2 is an enlarged view, fragmentally illustrated, of any of the several sandwiches of a pair of rail tabs and air turning vanes illustrated in FIG. 6.
Figure 3:
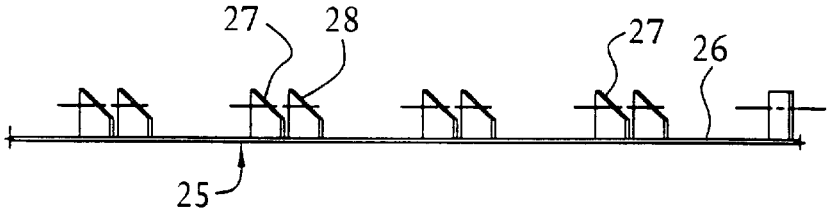
FIG. 3 is a side view of the vane rail illustrated in FIG. 8, with partially severed tabs, in pairs, disposed perpendicular to the base of the rail, with tab wings bent outwardly from the main bodies of the tabs, in non-planar relation thereto.
Figure 4:
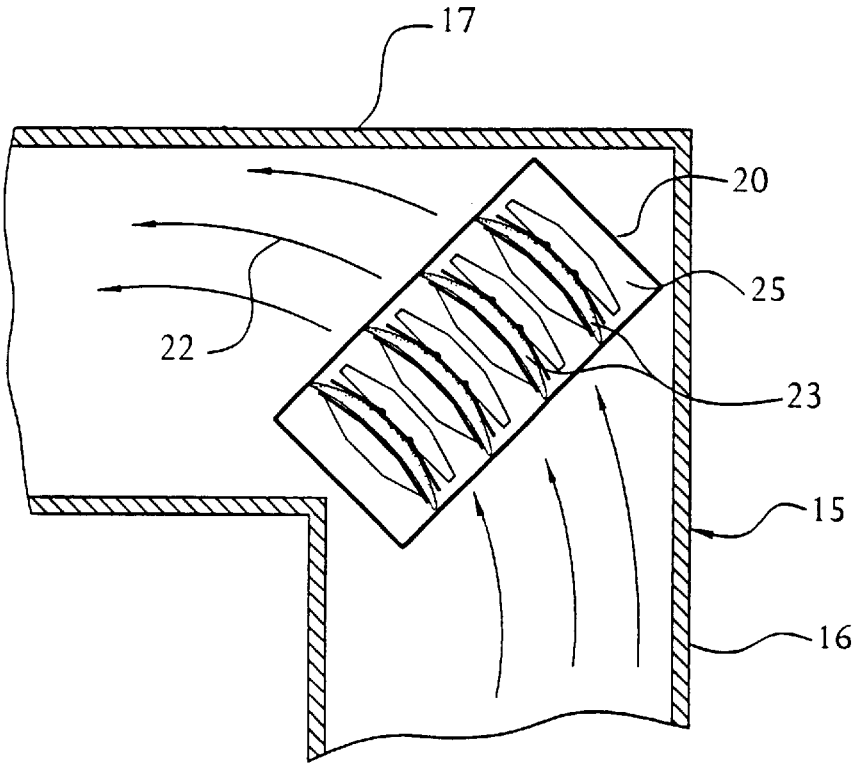
FIG. 4 is a sectional view taken through the duct and assembly of FIG. 1, generally along the line IV—IV of FIG. 1, where in the air turning effect provided by the vanes is schematically shown.
Figure 5:
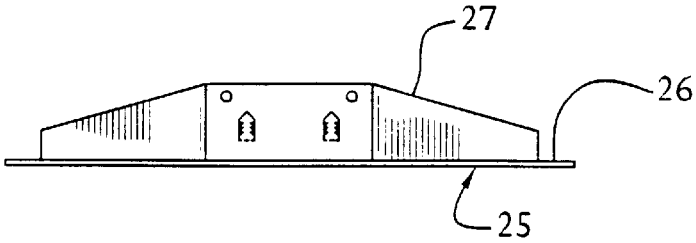
FIG. 5 is a right end view of the vane rail of FIG. 8, taken generally along the line V—V of FIG. 8.
Figure 6:
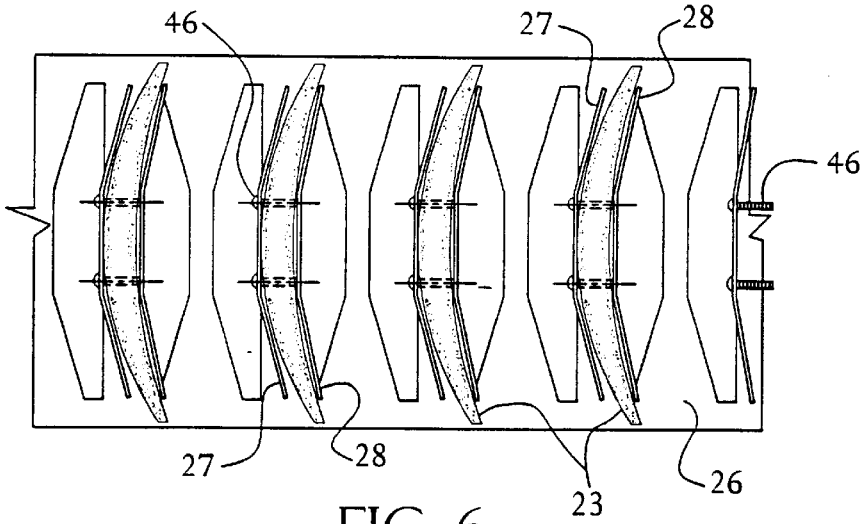
FIG. 6 is a top view of the vane rail of FIG. 8, with vanes illustrated in sandwiched relation between pairs of rail tabs.
Figure 7:
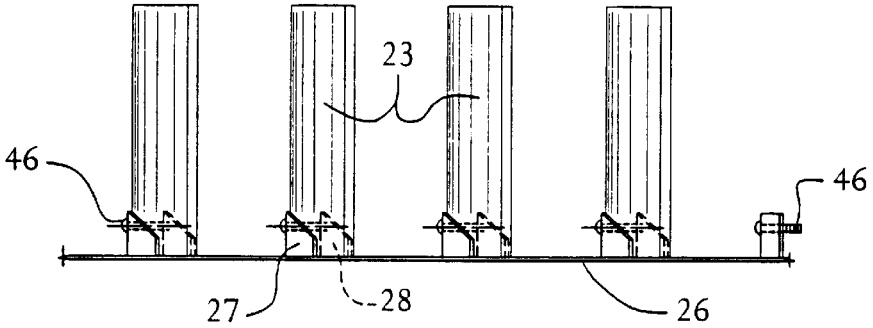
FIG. 7 is a front view of the rail and vanes of FIG. 6.
Figure 8:
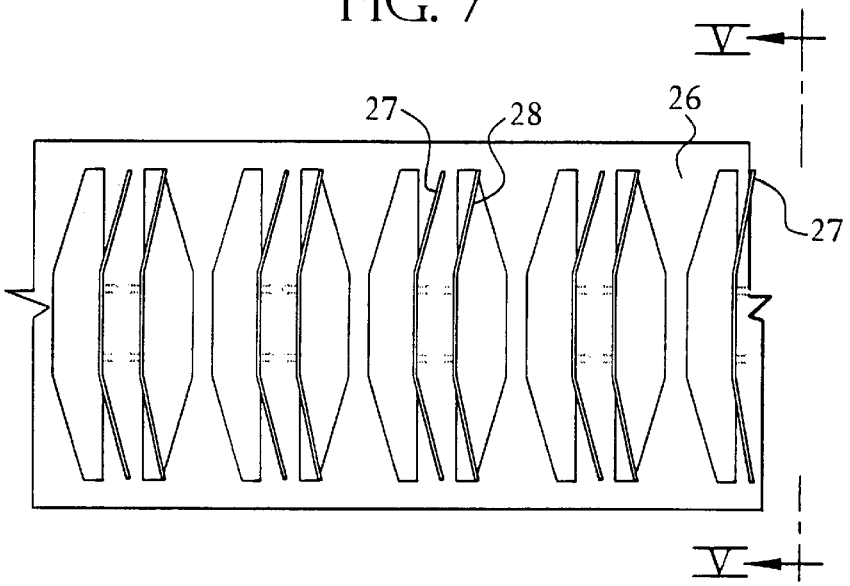
FIG. 8 is a fragmentary top view of a vane rail in accordance with this invention, wherein a plurality of pairs of tabs are shown, partially severed from the rail from which they are cut, and partially connected thereto, being shown with the tabs bent generally perpendicular to the rail base, and with wings being shown bent relative to the main bodies of the tabs, in non-planar relation thereto.

The vane and rail assembly 20 is comprised of a pair of rails 24, 25 that engage the vanes 23 at opposite ends of the vanes, as shown in FIG. 1. Each rail 24, 25, is preferably of sheet metal construction, although other materials of construction, such as plastic, or other materials may likewise be substituted for sheet metal. Each rail 24, 25 comprises a base 26 and a plurality of pairs of tabs 27, 28 partially severed therefrom along severance lines 30, 31, 32, 33, 34, 35 and 36, but integral with the base 26, being foldably connected thereto along a connect line 37, such that each tab, 27, 28 may be folded out of the plane of the base 26 of the rail 25, to be essentially perpendicular thereto, as shown in FIG. 3, for example. Each tab 27,28 has a main body portion 38 connected to a pair of wings 40 and 41, along bend lines 42, 43, respectively, such that the wings 40, 41 may be bent to be in non-planar relation relative to the main portion 38 of the tab, to be angularly disposed relative thereto, as shown for example in FIGS. 2, 8 and 10. It will be noted, that, if desired, the main body portion 38 and associated tabs 40, 41 of each tab may be placed in non-planar relation relative to each other by being bent or otherwise configured to be of arcuate configuration, in whole or in part, as may be desired.

Each tab 27, 28 is preferably provided with a plurality of perforations 44 and/or 45. The perforations 44 can be in the form of simple holes or the like for application of sheet metal screws or the like 46 therethrough, to engage within vanes 23, to secure the tabs 27, 28 to the vanes 23, for securely anchoring vanes 23 to the rails 24, 25.

Figure 9:
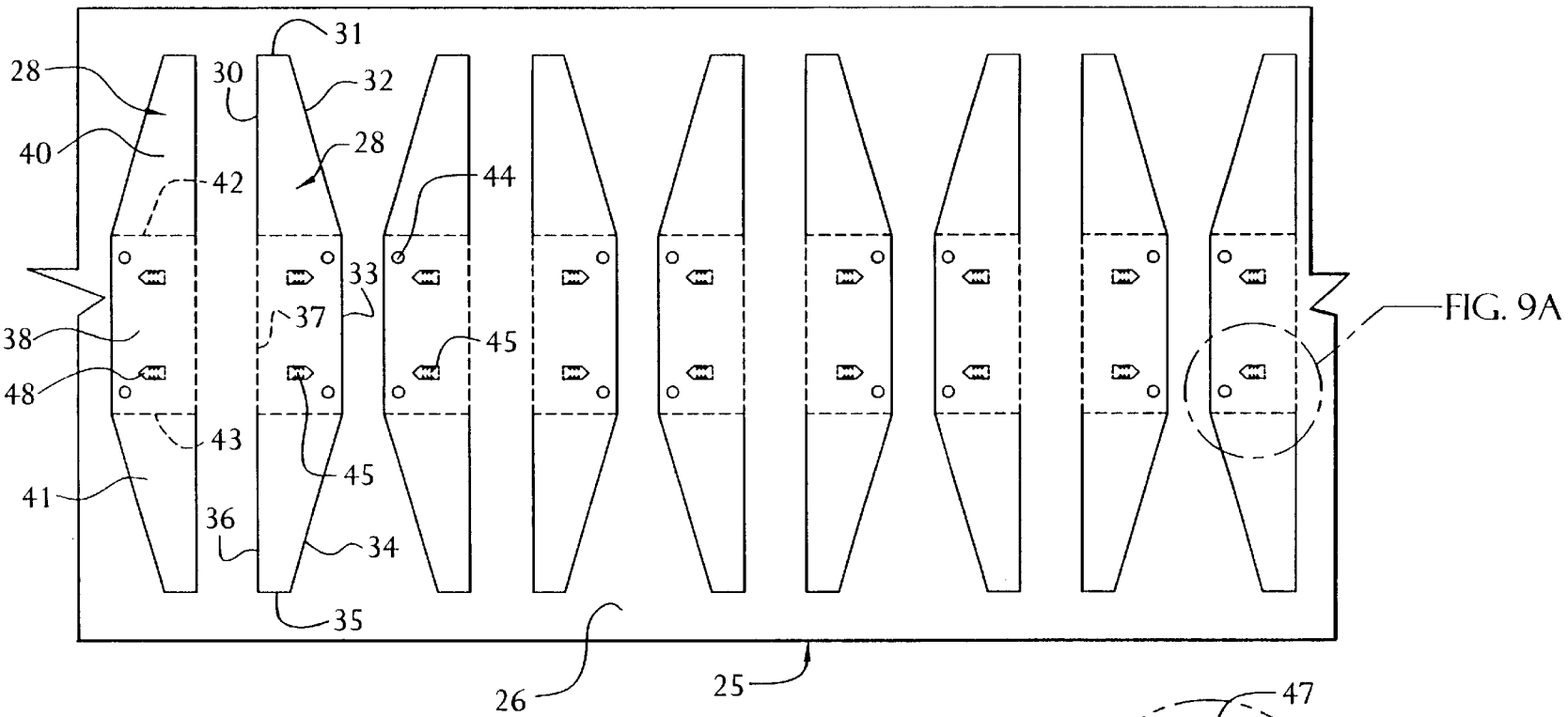
FIG. 9 is an enlarged fragmentary view of the vane rail of FIG. 8, prior to bending of the tabs perpendicular to the rail base thereof.
Figure 9A:
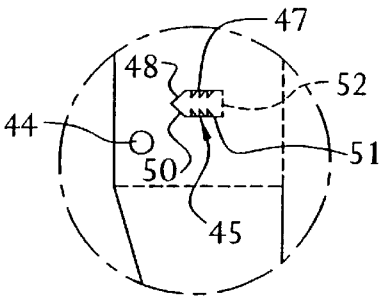
FIG. 9A is an enlarged, detail view of the indicated portion of the drawing of FIG. 9.
Figure 10:
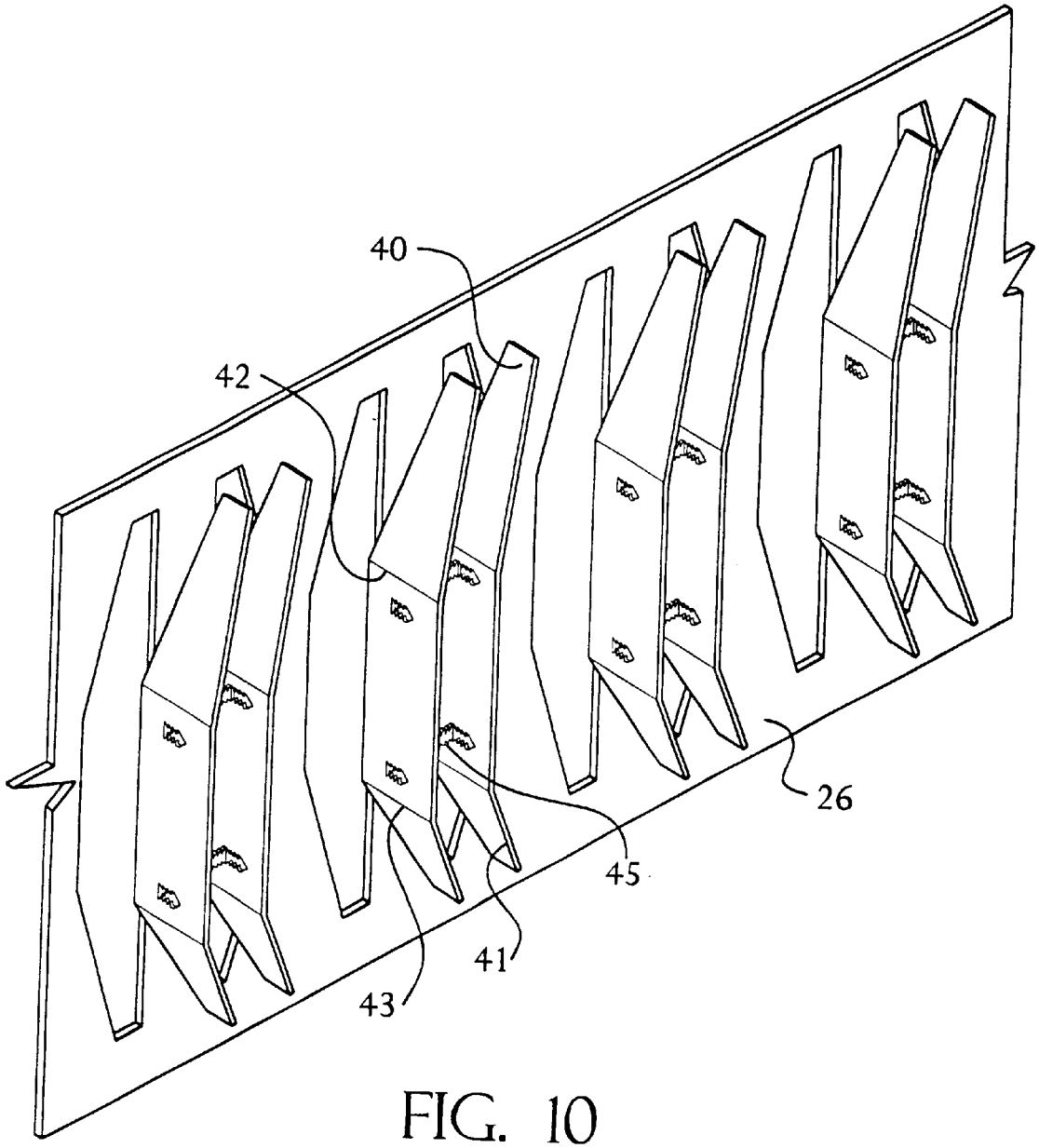
FIG. 10 is an enlarged perspective view of the vane rail of FIG. 8.

An alternative fastening means 45 may be in the form of barbs as shown most clearly in FIG. 9A, which can be formed from the main bodies 38 of the tabs 27, 28, by being cut along severance lines 47, 48, 50 and 51 and bent along bend line 52, to be approximately perpendicular to the main body portions 38 of the tabs, bent inwardly as shown in FIG. 10, to impinge with and engage with vanes 23 that are placed in sandwiched relation between pairs of tabs 27, 28 when the tabs 27, 28 are bent upwardly to be generally perpendicular to the rail base 26 as shown in FIG. 10.

It will also be apparent that the fasteners of the invention can be used together, such that screws 46 are used in addition to barbs 45.

It will thus be shown that, when vanes 23 are placed between pairs of tabs 27, 28 and fastened therein by means of suitable fasteners 46 and/or 45, the tabs 27, 28 are complementally configured to securely house vanes therein, as illustrated in the drawing figures.

It will be apparent from the foregoing that various modifications may be made in the details of construction, the choice of materials and in the general arrangement of parts, all within the spirit and scope of the invention as defined in the appended claims.

What is claimed is:

1. A vane rail for mounting air turning vanes in an air duct, comprising:

(a) a generally planar base;

(b) a plurality of pairs of tabs, each tab being partially severed from the base and partially integral therewith along a tab connect line, with the tabs being disposed generally perpendicular to the said base;

(c) each tab including a main body and at least one wing integral therewith and separated from the base;

(d) at least some of the wings of tabs in each said pair of tabs being disposed in non-planar relation to the main bodies of said tabs;

(e) with each pair of tabs with associated integral wings defining a spaced-apart, vane-receiving zone disposed generally perpendicular to said base, for receiving a generally curved vane in sandwiched relation therein.

2. The vane rail of claim 1, wherein each said tab in a pair defines a generally complemental configuration with other tab in said pair.

3. The vane rail of claim 1, wherein perforations are provided in tabs comprising means for facilitating fastening of tabs to vanes sandwiched thereby.

4. The vane rail of claim 3, wherein said perforations comprise holes for receiving fasteners therein.

5. The vane rail of claim 3, wherein said perforations comprises barbs partially severed from the tabs and partially integral therewith along barb connect lines.

6. The vane rail of any one of claims 1–5, wherein the base and tabs are comprised of sheet metal, with the tab connect lines comprising bend lines.

7. The vane rail of any one of claims 1–5, wherein the main body of each tab is integrally connected to a pair of angularly disposed wings at opposite ends of the main body.

8. An air turning vane and rail assembly for disposition in an air duct for intercepting air flow in a duct and diverting air flow in a duct to a different direction, comprising a pair of vane rails for mounting air turning vanes in a duct, each vane rail comprising:

(a) a generally planar base;

(b) a plurality of pairs of tabs, each tab being partially severed from the base and partially integral therewith along a tab connect line, with the tabs being disposed generally perpendicular to the said base;

(c) each tab including a main body and at least one wing integral therewith and separated from the base;

(d) at least some of the wings of tabs in each said pair of tabs being disposed in non-planar relation to the main bodies of said tabs;

(e) with each pair of tabs and associated integral wings defining a spaced apart, vane-receiving zone disposed generally perpendicular to said base;

and (f) an air flow vane disposed between tabs of each pair of tabs, in sandwiched relation, whereby each assembly sandwiches a plurality of vanes between pairs of vain rails at opposite ends of the vanes.

9. The assembly of claim 8, wherein each said tab in a pair defines a generally complemental configuration with other tab in said pair.

10. The assembly of claim 8, wherein fasteners are provided, in fastening engagement between tabs and vanes.

11. The assembly of claim 10, wherein the fasteners comprise screws.

12. The assembly of claim 10, wherein the fasteners comprise barbs partially severed from the tabs and partially integral therewith along barb connect lines.

13. The assembly of any one of claims 8–12, wherein the bases and tabs are comprised of sheet metal, with the tab connect lines comprising bend lines.

14. The assembly of claim 8, wherein the vanes are at least partially of formed fiberglass construction.

15. The assembly of any one of claims 8–12, wherein the main body of each tab is integrally connected to a pair of angularly disposed wings at opposite ends of the main body.

16. An air duct assembly comprising first and second air duct legs and an air turning section therebetween; said air turning section including an air turning vane and rail assembly in accordance with claim 8.

17. A vane rail for mounting air turning vanes in an air duct, comprising:

(a) a generally planar base;

(b) a plurality of pairs of tabs, each tab being partially severed from the base and partially integral therewith along a tab connect line, with the tabs being disposed generally perpendicular to the said base;

(c) each tab including a main body and at least one wing integral therewith;

(d) at least some of the wings of tabs in each said pair of tabs being disposed in non-planar relation to the main bodies of said tabs;

(e) with each pair of tabs with associated integral wings defining a spaced apart, vane-receiving zone disposed generally perpendicular to said base, for receiving a generally curved vane in sandwiched relation therein;

(f) wherein perforations are provided in tabs comprising means for facilitating fastening of tabs to vanes sandwiched thereby.

18. The vane rail of claim 17, wherein said perforations comprise for receiving fasteners therein.

19. The vane rail of claim 17, wherein said perforations comprise barbs partially severed from the tabs and partially integral therewith along barb connect lines.

20. The vane rail of any one of claims 17–19, wherein the main body of each tab is integrally connected to a pair of angularly disposed wings at opposite ends of the main body.

21. An air turning vane and rail assembly for disposition in an air duct for intercepting air flow in a duct and diverting air flow in a duct to a different direction, comprising a pair of vane rails for mounting air turning vanes in a duct, each vane rail comprising:

(a) a generally planar base;

(b) a plurality of pairs of tabs, each tab being partially severed from the base and partially integral therewith along a tab connect line, with the tabs being disposed generally perpendicular to the said base;

(c) each tab including a main body and at least one wing integral therewith;

(d) at least some of the wings of tabs in each said pair of tabs being disposed in non-planar relation to the main bodies of said tabs;

(e) with each pair of tabs and associated integral wings defining a spaced-apart, vane-receiving zone disposed generally perpendicular to said base;

and (f) an air flow vane disposed between tabs of each pair of tabs, in sandwiched relation, whereby each assembly sandwiches a plurality of vanes between pairs of vain rails at opposite ends of the vanes;

(g) wherein fasteners are provided, in fastening engagement between tabs and vanes.

22. The assembly of claim 21, wherein the fasteners comprise screws.

23. The assembly of claim 21, wherein the fasteners comprise barbs partially severed from the tabs and partially integral therewith along barb connect lines.

24. The assembly of any one claims 21–23, wherein the main body of each tab is integrally connected to a pair of angularly disposed wings at opposite ends of the main body.

* * * * *

UNITED STATES PATENT AND TRADEMARK OFFICE

CERTIFICATE OF CORRECTION

PATENT NO. : 6,244,300 B1
DATED : June 12, 2001
INVENTOR(S) : David M. Pacana

It is certified that error appears in the above-identified patent and that said Letters Patent is hereby corrected as shown below:

Title page,
Item [22], delete "Dec. 10, 1999" and replace with -- July 14, 1999 --.

Column 4, claim 8,
Line 32, delete "spaced apart" and replace with -- spaced-apart --.

Signed and Sealed this

Second Day of April, 2002

*Attest:*

*Attesting Officer*

JAMES E. ROGAN
*Director of the United States Patent and Trademark Office*